US006106235A

United States Patent [19]

Tettenborn et al.

[11] Patent Number: 6,106,235

[45] Date of Patent: Aug. 22, 2000

[54] CO-MOLDED FAN VANE

[75] Inventors: Mike Tettenborn, Wiarton; Mike Sirois, Nepean, both of Canada

[73] Assignee: Caframo Ltd., Iarton, Canada

[21] Appl. No.: 09/275,095

[22] Filed: Mar. 24, 1999

[51] Int. Cl.[7] ..... F04D 29/32

[52] U.S. Cl. ..... 416/229 R; 416/63; 416/213 A; 416/240; 416/241 A

[58] Field of Search ..... 416/63, 213 A, 416/229 R, 230, 224, 240, 241 A, 247 R; 417/411, 423.1, 234; 264/254, 255, 275

[56] References Cited

U.S. PATENT DOCUMENTS 3,475,530 10/1969 Cooper ..... 264/247
4,251,189 2/1981 Zinsser et al. ..... 416/240
5,851,106 12/1998 Steiner et al. ..... 416/63
5,993,158 11/1999 Young ..... 416/132 R

FOREIGN PATENT DOCUMENTS 0 266 952 B1 8/1991 European Pat. Off. .

*Primary Examiner*—Edward K. Look
*Assistant Examiner*—Liam McDowell
*Attorney, Agent, or Firm*—Marks & Clerk; Paul S. Sharpe

[57] ABSTRACT

Co-molded fan vanes on a propeller. The vanes provide a soft, flexible material guard along the leading edge of each vane. This obviates the use of a propeller edge guard without concern for injury.

18 Claims, 2 Drawing Sheets

CO-MOLDED FAN VANE

FIELD OF THE INVENTION

The present invention relates to a fan vane for use in room fans, personal fans or other such fans and more particularly, the present invention relates to such fan vanes having protective edges to avoid personal injury.

BACKGROUND OF THE INVENTION

Fan vanes with protective devices have been previously proposed in the art. Typically, the known arrangements are of a mechanical variety and include blunt edges, or edges having a softer material mechanically fixed to the leading edges of each of the vanes of the propeller. These arrangements are generally useful, but over time, the point at which the device is fixed to the vane becomes worn due to continuous centripetal forces or alternatively, such devices do not fit precisely and this results in undesirable noise. A further disadvantage to the mechanical systems is that they tend to add significant mass to the vanes of the propeller which, in turn, is translated to the motor. This may cause the motor to overheat and in situations where the motors are battery driven, such as would be the case with personal systems, the result is premature battery drain. In the existing arrangements, turbulence or localized eddies also pose problems.

Other arrangements that have been previously proposed include glue or mechanical fastening such as with rivets, etc. These methods are extremely labour intensive and further, are quite susceptible to wear and eventual failure. In the case of the adhesive connection, over time, moisture conditions may alter the bond of the guard to the vane of the propeller thus resulting in the guard being thrown from the leading edge of the vane. This obviously creates a hazardous situation.

In view of the limitations of the prior art, it is clear that there exists a need for an improved method of bonding a guard to a leading edge of a propeller which does not suffer the limitations associated with mechanical fixture, attachment or adhesive attachment. The present invention is directed to satisfying this need and provides an improved arrangement.

SUMMARY OF THE INVENTION

One object of the present invention is to provide an improved fan vane.

A further object of one embodiment of the present invention is to provide a fan propeller, comprising:

- a propeller having a plurality of vanes, each vane of the vanes having a leading edge at least a portion of the leading edge comprising a first polymeric material having a first degree of rigidity; and
- a second polymeric material different from the first polymer and having a second degree of rigidity reduced relative to the first degree fused with each leading edge, whereby each leading edge is flexible.

As is generally known in the art, for portable or personal type fans, the amount of air reaching the user during the rotation of the fan, is hindered by the propeller cager or protective devices. It is also generally known that the wire type cages often induce localized eddy currents which also reduce the amount of air reaching the user. By providing a flexible leading edge on the vanes of the propeller, safety is no longer a concern. The material of the leading edge may be selected from any suitable visco elastomer or elastomers such as Santoprene™ which is a flexible material. This would prevent the inherent danger of removing the cage or propeller container since if the user were to come in contact with the propeller, the leading edges of the vanes would not induce any pain or physical damage. Other suitable materials will be readily appreciated by those skilled in the art.

In accordance with a further object, there is provided a portable fan, comprising:

- a support body;
- a power source;
- a propeller having a plurality of vanes, each vane of the vanes having a leading edge at least a portion of the leading edge comprising a first polymeric material having a first degree of rigidity;
- a second polymeric material different from the first polymer and having a second degree of rigidity reduced relative to the first degree fused with each leading edge, whereby each leading edge is flexible; and
- a motor for driving said propeller.

As a further advantage the polymeric material of which the propeller may be formed, i.e., polypropylene, polystyrene, polyethylene, polyvinyl chloride, inter alia, will have a different or approximately the same melting point than the leading edge polymer. As such, when the two materials are co-molded, there is effectively chemical fusion between the two polymers and thus the applied leading edge material remains effectively integrally bonded with the leading edge of the first polymeric material. As an advantage, the first and second polymeric materials may comprise congeners to facilitate adequate fusion.

A further object of the present invention is to provide a method of forming a soft leading edge on fan propeller vanes, comprising:

- providing a propeller having a plurality of vanes, the vanes composed of a first polymeric material having a first degree of rigidity, the vanes each having a leading edge;
- providing a second polymeric material having a different melting point from the first polymeric material and reduced rigidity relative to the first material; and
- fusing the second polymeric material about each leading edge to form a flexible leading edge.

Having thus described the invention, reference will now be made to the accompanying drawings illustrating preferred embodiments.

BRIEF DESCRIPTION OF THE DRAWINGS

Similar numerals in the figures denote similar elements.

DETAILED DESCRIPTION OF THE PREFERRED EMBODIMENTS

Figure 1:
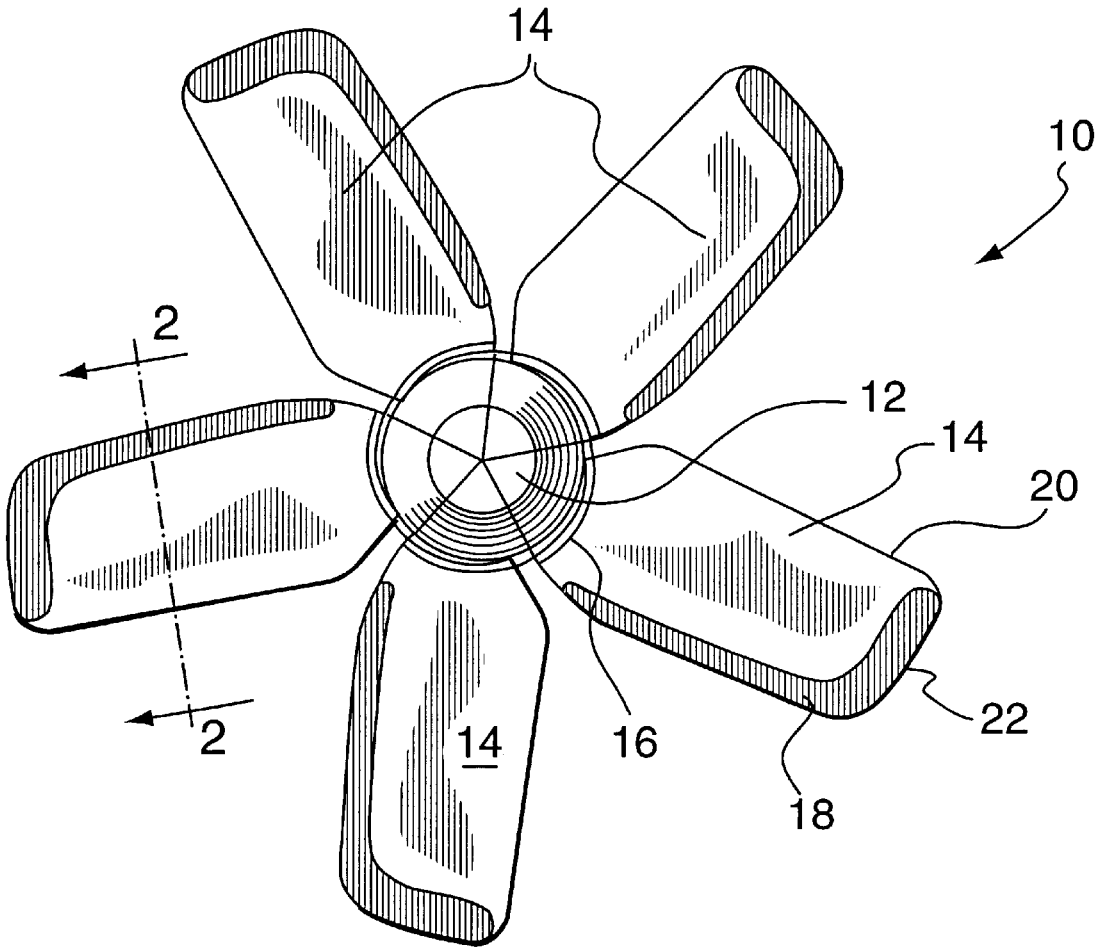
FIG. 1 is a top plan view of the propeller vane according to one embodiment of the present invention.

Referring now to FIG. 1, shown is a fan propeller globally denoted by numeral 10. The propeller includes a central hub member 12 from which radiate a plurality of individual vanes 14. The vanes are connected at one end 16 thereof. Each vane 14 includes a leading edge 18, a trailing edge 20 and a bottom edge 22, with the general configuration known in the art.

Figure 2:
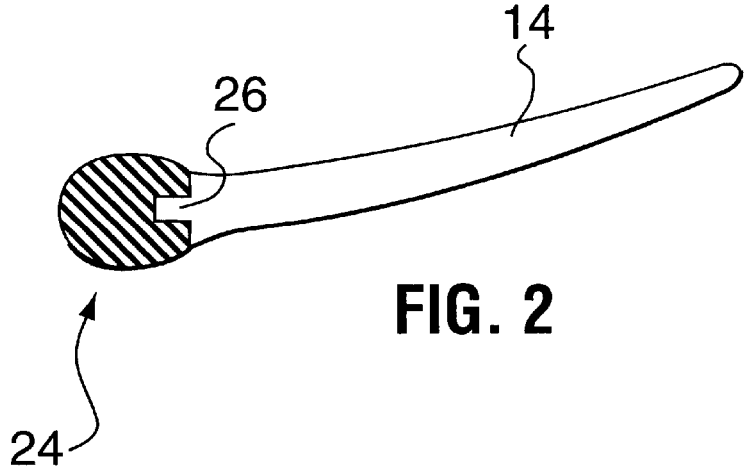
FIG. 2 is a sectional line 2—2 of FIG. 1.

As is illustrated in FIG. 1, the trailing edge 18 of each vane 14 and the bottom edge 22, each include a flexible co-molding shown best in FIG. 2. The co-molded section is generally denoted by numeral 24. In the illustration of the section of the vane 14 in FIG. 2, the bottom edge is shown to include a projection 26, which projection mates with a similar cooperating recess clearly illustrated in the flexible formation 24 shown in FIG. 2. As a particularly convenient feature, the vane material 14 may comprise a first polymer selected from, for example, polyethylene, polypropylene, polystyrene, polyvinyl chloride as well as any of the other known thermoplastics.

Regarding the second polymeric material, of which the flexible formation 24 is composed, this material will preferably have a lower melting point than the material of which the vanes 14 are made and may be selected from suitable visco elastomers or known elastomers, a most desirable example of which is Santoprene™. The second polymeric material formation may cover an area from about 5% of the vane to about 60% of the vane depending upon the intended use of the propeller vane and the environment in which it will be used. In terms of the melting points for the materials, polypropylene for example, for the vane material, has a melting point of 280° C. whereas the Santoprene™ visco elastomer material has a melting point of 244° C. so that once the Santoprene™ is contacted by the polypropylene material, a suitable chemical bond can form therebetween by fusion. In the example, the materials are co-molded such that formation 24, shown in FIG. 2, is integrally molded onto the vane 14. In the example, the preferred materials for the vane is polypropylene whereas for the second material, Santoprene™ is preferred. These materials are lightweight and are chemical congeners of one another. It will be appreciated, however, that suitable other congeners can easily be employed where the second material has a higher flexibility than the material of which the vane is made in order to achieve the advantages obtained by the present invention.

Figure 3:
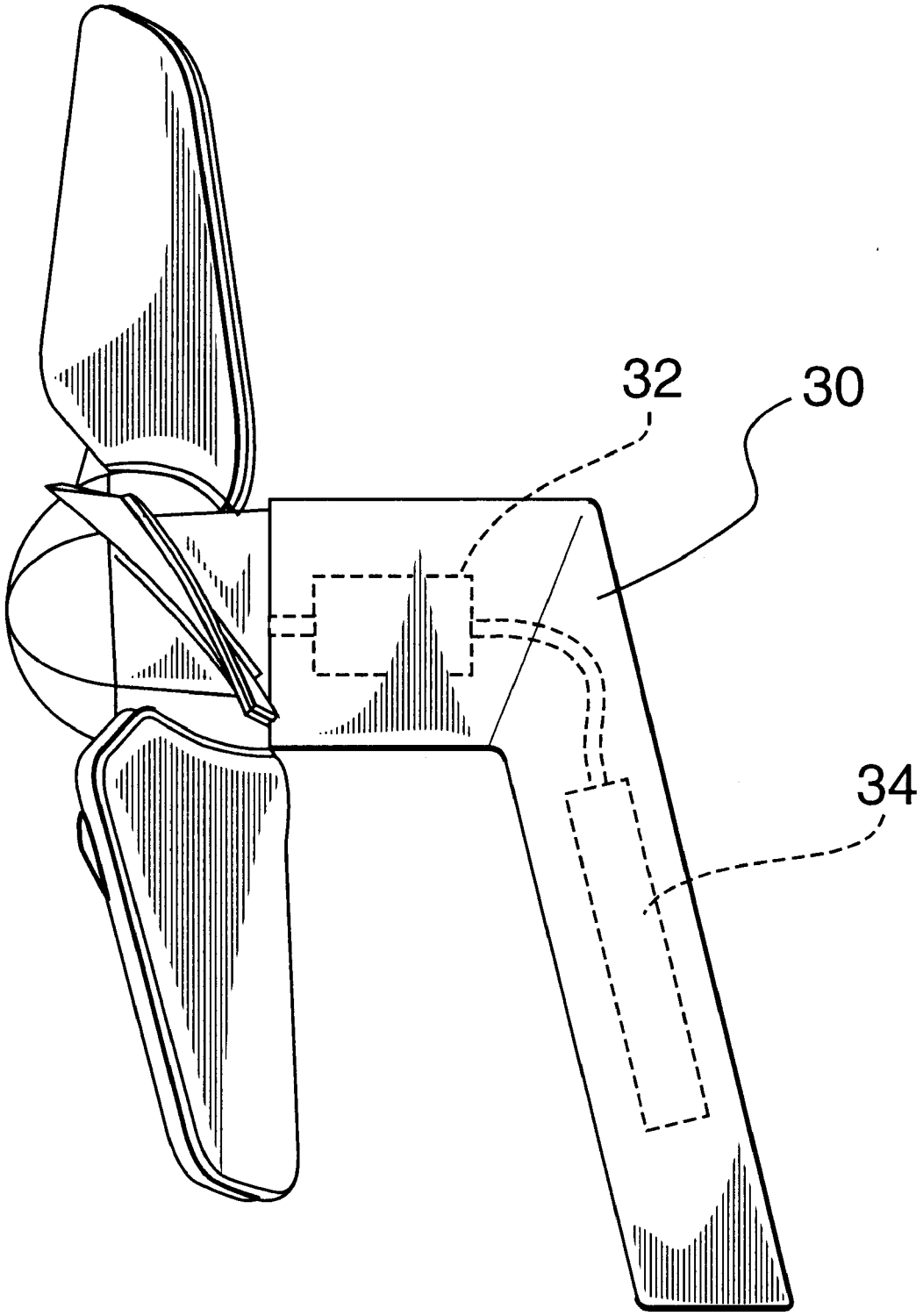
FIG. 3 is a side view of the propeller as used in a fan system.

FIG. 3 illustrates the arrangement in use in the absence of a propeller cage where the portable fan system has a body 30, a motor 32 and a power source, shown in the example as a battery 34.

Although embodiments of the invention have been described above, it is not limited thereto and it will be apparent to those skilled in the art that numerous modifications form part of the present invention insofar as they do not depart from the spirit, nature and scope of the claimed and described invention.

What is claimed is:

1. A fan propeller, comprising:

a propeller having a plurality of vanes, each vane of said vanes having a leading edge at least a portion of said leading edge comprising a first polymeric material having a first degree of rigidity; and a second polymeric material different from said first polymer and having a second degree of rigidity reduced relative to said first degree fused with each said leading edge, whereby each said leading edge is flexible.

2. The propeller as set forth in claim 1, wherein each vane of said vane of said vanes has said leading edge, a trailing edge and a bottom edge, said second polymeric material being fused to said leading edge and said bottom edge.

3. The propeller as set forth in claim 1, wherein said second polymeric material and said first polymeric material are chemical congeners.

4. The propeller as set forth in claim 3, wherein said second polymeric material has a melting point greater than said first polymeric material.

5. The propeller as set forth in claim 1, wherein said second polymeric material covers from between 5% and 60% of the area of each said vane.

6. The propeller as set forth in claim 1, said first polymeric material selected from the group comprising polypropylene, polystyrene, polyethylene, polyvinyl chloride or mixtures thereof.

7. The propeller as set forth in claim 1, wherein said second polymeric material is selected from the group comprising visco elastomers, elastomers and combinations thereof.

8. The propeller as set forth in claim 7, wherein said second polymeric material comprises Santoprene™.

9. A portable fan, comprising:

a support body;

a power source;

a propeller having a plurality of vanes, each vane of said vanes having a leading edge at least a portion of said leading edge comprising a first polymeric material having a first degree of rigidity;

a second polymeric material different from said first polymer and having a second degree of rigidity reduced relative to said first degree fused with each said leading edge, whereby each said leading edge is flexible; and a motor for driving said propeller.

10. The propeller as set forth in claim 9, wherein each vane of said vane of said vanes has said leading edge, a trailing edge and a bottom edge, said second polymeric material being fused to said leading edge and said bottom edge.

11. The propeller as set forth in claim 9, wherein said second polymeric material and said first polymeric material are chemical congeners.

12. The propeller as set forth in claim 11, wherein said second polymeric material has a melting point greater than said first polymeric material.

13. The propeller as set forth in claim 9, wherein said second polymeric material covers from between 5% and 60% of the area of each said vane.

14. The propeller as set forth in claim 9, said first polymeric material selected from the group comprising polypropylene, polystyrene, polyethylene, polyvinyl chloride or mixtures thereof.

15. The propeller as set forth in claim 9, wherein said second polymeric material is selected from the group comprising visco elastomers, elastomers and combinations thereof.

16. A method of forming a soft leading edge on fan propeller vanes, comprising:

providing a propeller having a plurality of vanes, said vanes composed of a first polymeric material having a first degree of rigidity, said vanes each having a leading edge;

providing a second polymeric material having a different melting point from said first polymeric material and reduced rigidity relative to said first material; and fusing said second polymeric material about each said leading edge to form a flexible leading edge.

17. The method as set forth in claim 16, wherein said second polymer is co-molded with said first polymer.

18. The method as set forth in claim 16, wherein fused second polymer is integral with each said vane.

* * * * *